US008784069B2

(12) United States Patent
Lilie et al.

(10) Patent No.: US 8,784,069 B2
(45) Date of Patent: Jul. 22, 2014

(54) METHOD OF DETECTING IMPACT BETWEEN CYLINDER AND PISTON DRIVEN BY A LINEAR MOTOR, DETECTOR OF IMPACT BETWEEN A CYLINDER AND PISTON DRIVEN BY A LINEAR MOTOR, GAS COMPRESSOR, CONTROL SYSTEM FOR A CYLINDER AND A PISTON SET DRIVEN BY A LINEAR MOTOR GAS COMPRESSOR, CONTROL SYSTEM FOR A CYLINDER AND A PISTON SET DRIVEN BY A LINEAR MOTOR

(75) Inventors: Dietmar Erich Bernhard Lilie, Joinville SC (BR); Nerian Fernando Ferreira, Joinville SC (BR); Marcelo Knies, Joinville SC (BR); Paulo Sergio Dainez, Joinville SC (BR)

(73) Assignee: Whirlpool S.A., Sao Paulo (BR)

( * ) Notice: Subject to any disclaimer, the term of this patent is extended or adjusted under 35 U.S.C. 154(b) by 401 days.

(21) Appl. No.: 12/810,056

(22) PCT Filed: Nov. 24, 2008

(86) PCT No.: PCT/BR2008/000346

§ 371 (c)(1),
(2), (4) Date: Sep. 23, 2010

(87) PCT Pub. No.: WO2009/082799

PCT Pub. Date: Jul. 9, 2009

(65) Prior Publication Data

US 2011/0058960 A1 Mar. 10, 2011

(30) Foreign Application Priority Data

Dec. 28, 2007 (BR) ..... 0705049

(51) Int. Cl.
*F04B 49/00* (2006.01)

(52) U.S. Cl.
USPC ..... 417/44.1; 417/417; 417/44.11; 318/135

(58) Field of Classification Search
CPC ..... F04B 49/065; F04B 2201/0201; F04B 2203/04; H20P 4/48; H20P 4/50; H20P 6/08; H20P 7/06
USPC ..... 417/417, 45, 44.1, 44.11; 324/71; 318/38, 119, 135, 687; 327/71
See application file for complete search history.

(56) References Cited

U.S. PATENT DOCUMENTS 4,086,518 A 4/1978 Wilkinson
5,342,176 A 8/1994 Redlich (Continued)

FOREIGN PATENT DOCUMENTS

DE 103 14 007 10/2004
DE 10 2006 009 231 8/2007

(Continued)

OTHER PUBLICATIONS

International Search Report mailed Jun. 29, 2009 for International application No. PCT/BR2008/000346.

(Continued)

*Primary Examiner* — Devon Kramer
*Assistant Examiner* — Joseph Herrmann
(74) *Attorney, Agent, or Firm* — Fay Sharpe LLP

(57) ABSTRACT

A method of detecting impact or collision between a cylinder (2) and piston (1) driven by a linear motor of a gas compressor includes the steps of: i) obtainment of a reference signal (Sr) associated to an electrical output of the linear motor before the piston attains the upper dead center; ii) obtainment of a detection signal (Sd) associated to the electrical output of the linear motor after the piston attains the upper dead center; iii) comparison between the reference signal (Sr) and the detection signal (Sd); and iv) record of occurrence of impact when the result of comparison of step iii indicates that the detection signal (Sd) presents a variation deriving from impact between the cylinder and the piston, considering a pre-established tolerance. Also disclosed is an electronic detector device , a gas compressor (100) and a control system.

11 Claims, 4 Drawing Sheets

(56) References Cited

U.S. PATENT DOCUMENTS

Figure 1:
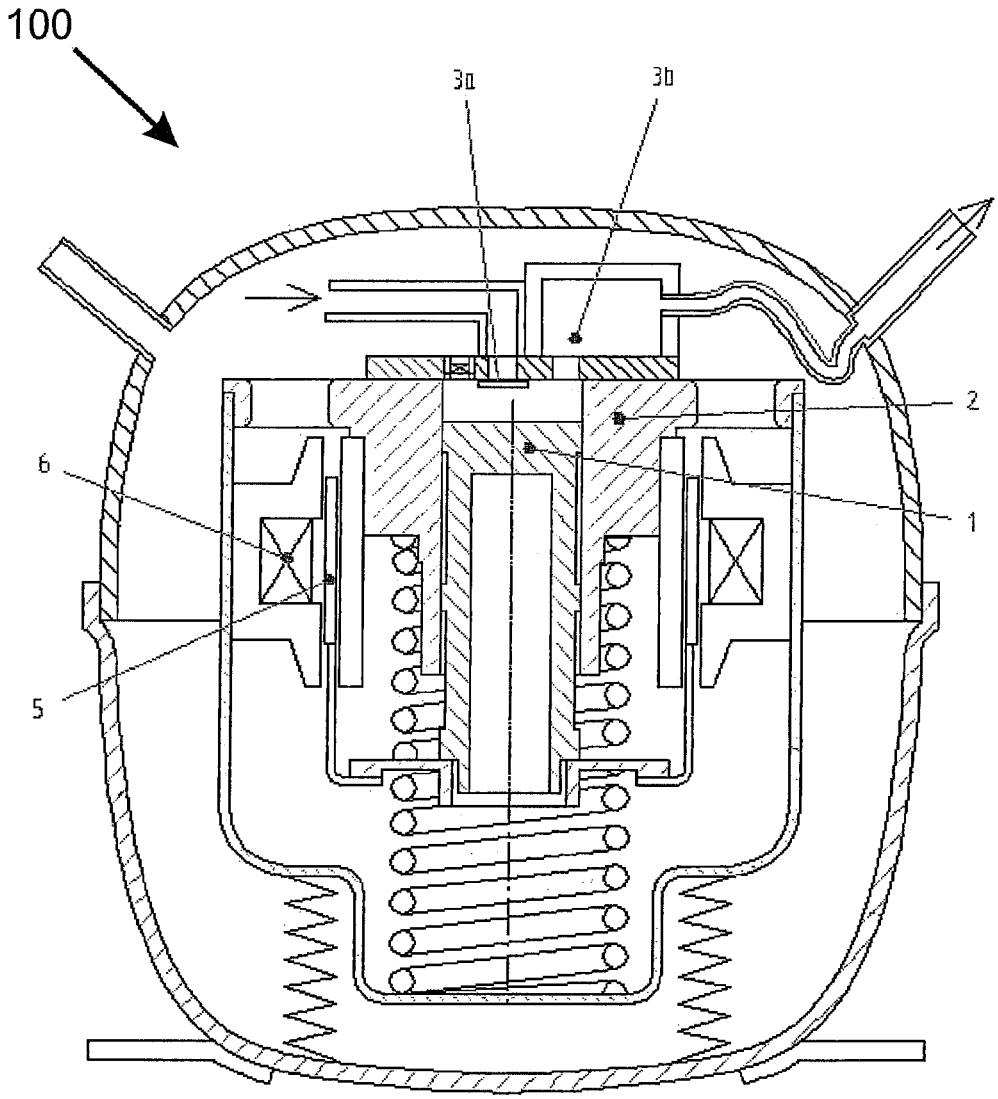

| | | | | |
|---|---|---|---|---|
| 5,423,192 | A * | 6/1995 | Young et al. | 62/228.4 |
| 5,897,296 | A * | 4/1999 | Yamamoto et al. | 417/44.1 |
| 6,034,493 | A * | 3/2000 | Boyd et al. | 318/400.31 |
| 6,176,683 | B1 * | 1/2001 | Yang | 417/44.1 |
| 6,588,380 | B2 * | 7/2003 | Ries-Mueller | 123/41.05 |
| 6,623,246 | B2 * | 9/2003 | Hwang et al. | 417/44.1 |
| 6,663,348 | B2 * | 12/2003 | Schwarz et al. | 417/12 |
| 6,811,380 | B2 * | 11/2004 | Kim | 417/44.1 |
| 7,090,470 | B2 * | 8/2006 | Kim | 417/44.11 |
| 7,235,939 | B2 * | 6/2007 | Viti | 318/400.35 |
| 7,285,878 | B2 * | 10/2007 | McGill et al. | 310/12.04 |
| 7,845,912 | B2 * | 12/2010 | Sung et al. | 417/44.11 |
| 8,125,166 | B2 * | 2/2012 | Reinschke | 318/135 |
| 2002/0064463 | A1 | 5/2002 | Park et al. | |
| 2003/0161734 | A1 | 8/2003 | Kim | |
| 2005/0168179 | A1 * | 8/2005 | McGill et al. | 318/119 |
| 2006/0070518 | A1 * | 4/2006 | McGill et al. | 91/359 |
| 2007/0095073 | A1 * | 5/2007 | Tian et al. | 62/6 |
| 2007/0152512 | A1 * | 7/2007 | Tian et al. | 310/12 |

FOREIGN PATENT DOCUMENTS

| | | |
|---|---|---|
| EP | 1 524 434 | 4/2005 |
| JP | 11-33661 | 12/1999 |
| WO | WO 00/63555 | 10/2000 |
| WO | WO 01/71186 | 9/2001 |
| WO | WO 2004/025120 | 3/2004 |
| WO | WO 2007/049876 | 5/2007 |
| WO | WO 2007/123323 | 11/2007 |

OTHER PUBLICATIONS

Written Opinion of the International Searching Authority mailed Jun. 29, 2009 for International application No. PCT/BR2008/000346.

Response to Written Opinion mailed Oct. 28, 2009 for International application No. PCT/BR2008/000346.

International Preliminary Report on Patentability completed Dec. 14, 2009 for International application No. PCT/BR2008/000346.

* cited by examiner

METHOD OF DETECTING IMPACT BETWEEN CYLINDER AND PISTON DRIVEN BY A LINEAR MOTOR, DETECTOR OF IMPACT BETWEEN A CYLINDER AND PISTON DRIVEN BY A LINEAR MOTOR, GAS COMPRESSOR, CONTROL SYSTEM FOR A CYLINDER AND A PISTON SET DRIVEN BY A LINEAR MOTOR GAS COMPRESSOR, CONTROL SYSTEM FOR A CYLINDER AND A PISTON SET DRIVEN BY A LINEAR MOTOR

The present invention discloses a method capable of detecting the occurrence of impact or collision between a cylinder and piston, driven by a linear motor, in a gas compressor.

The present invention also discloses an electronic device capable of detecting the occurrence of impact or collision between a cylinder and piston, driven by a linear motor, in a gas compressor.

The present invention also discloses a gas compressor that comprises the above-mentioned device.

The present invention further discloses a control system for a cylinder and piston set, driven by a linear motor that comprises the above-mentioned device.

DESCRIPTION OF THE STATE OF THE ART

Currently, the use of piston and cylinder sets driven by linear motors is commonplace. This type of set is advantageously applied, for example, to linear compressors in refrigeration systems, such as refrigerators and air-conditioning appliances. The linear compressors present low energy consumption and, therefore, are highly efficient for the application in question.

The linear compressor normally comprises a piston which moves inside a cylinder. The head of this cylinder normally houses gas suction valves and gas discharge valves, which regulate the entry of low pressure gas and the exit of high pressure gas from inside the cylinder. The axial motion of the piston inside the cylinder of the linear compressor compresses the gas allowed in by the suction valve, increasing the pressure thereof, and discharging it by the discharge valve to a high pressure zone. Alternatively, there are configurations of linear compressors wherein the suction valve is positioned on the piston, or wherein the valve board may be absent, in which case the discharge valve covers all the top of the cylinder.

The linear compressor must be capable of controlling the displacement of the piston inside the cylinder to prevent the piston from colliding with the cylinder head, or with other components arranged at the other end of the piston path, which causes a loud and unpleasant noise, in addition to wear and tear of the equipment. Nevertheless, in order to optimize the efficiency and the performance of the linear compressor and minimize the compressor's consumption of power, it is desirable that the piston should be displaced as much as possible inside the cylinder, approaching as close as possible to the piston head without colliding with it.

Normally, said displacement control of the piston is performed by sensors capable of identifying the position of the piston. In this case, the displacement amplitude of the cylinder when the compressor is in operation must be known precisely, and the larger the estimated error of this amplitude, the greater the safety distance will have to be between the maximum point of displacement of the piston and the cylinder head to avoid collision thereof. This safety distance provides a loss in efficiency of the compressor.

Certain mechanisms and systems that control the axial displacement of the piston inside the cylinder of a linear compressor are already known within the state of the art. These include document JP 11336661 which discloses a piston position control unit that uses discrete position signals measured by a position sensor and subsequently interpolates them to determine the maximum advance position of the piston. With this solution, it is possible to reach a high degree of accuracy of the displacement amplitude of the piston. However, measuring the displacement amplitude of the piston is not performed at the site of interest that measures that distance between the piston and the cylinder head. This is why the system disclosed in this document is subject to tolerances in the assembly position of the position sensor.

Document BR 0001404-4 describes a position sensor particularly applicable for detecting the position of an axially displaceable compressor. The compressor comprises a valve blade that is placed between the head and a hollow body where the piston moves. The sensor comprises a probe electrically connected to a control circuit, the probe being capable of capturing the passage of the piston by a point of the hollow body and signal the control circuit. This system is, therefore, capable of measuring the distance between the piston and the cylinder head, but the architecture of the electrical circuit used as cylinder position transducer generates undesirable electrical noise, due to the electrical contact failures, which generates inaccurate readings.

Document BR 0203724-6 proposes another way of detecting the piston position in a linear compressor to prevent it from colliding with the fluid transfer board when variations occur in the compressor operating conditions or even in the power voltage. The solution proposed in this document measures the distance between the piston and the fluid board directly on the top of the piston, and is therefore a highly accurate solution. However, this architecture needs space for installing the valve board sensor and it is more costly.

The documents of the state of the art mentioned above describe solutions based on the direct measuring of the position and displacement of the piston by way of specific sensors and, apparently, they are not capable of marrying good control accuracy with low cost. Moreover, said solutions involve a certain complexity of implementation, hampering the production process, since high assembly precision is required. Additionally, the use of a position or displacement sensor requires the allocation of additional space in the compressor, which is undesirable, as it hinders the development of a compact product that occupies an optimized space.

Document U.S. Pat. No. 5,342,176 proposes a method to predict the amplitude of piston operation by monitoring the motor variables, such as current and voltage applied to the permanent magnet linear motor. In other words, the linear motor itself is the piston position transducer. This solution presents the advantage of dispensing with the use of an additional transducer, such as a sensor, inside the compressor. However, the method proposed has the major drawback of having very low precision, which causes a considerable performance loss for the compressor, because it requires a large safety distance between the piston and the cylinder head in order to avoid collision.

OBJECTIVES OF THE INVENTION

A first objective of the invention consists of providing a methodology for detecting an impact between a cylinder and piston driven by a linear motor that dispenses with the use of a sensor.

A second objective of the invention consists of providing an impact detector between a cylinder and piston driven by a linear motor, having low cost and that dispenses with the use of a sensor.

A third objective of the invention consists of providing a gas compressor capable of detecting impact between a cylinder and piston driven by a linear motor, having low cost and that dispenses with the use of a sensor.

A fourth objective of the invention consists of providing a control system capable of preventing impact of the piston with the cylinder, which presents good accuracy.

BRIEF DESCRIPTION OF THE INVENTION

The first objective of the present invention is achieved through a method of detecting impact between a cylinder and a piston driven by a linear motor, comprising the steps of:

i) obtainment of a reference signal associated to an electrical output of the linear motor before the piston attains the upper dead center;

ii) obtainment of a detection signal associated to said electrical output of the linear motor after the piston attains the upper dead center;

iii) comparison between the reference signal and the detection signal; and iv) record of occurrence of impact when the result of comparison of step iii indicates that the detection signal has a variation deriving from the impact between the cylinder and the piston considering a pre-established tolerance.

The second objective of the present invention is achieved by the provision of a detector of impact between a cylinder and a piston driven by a linear motor comprising at least a conditioning circuit electrically connected to the linear motor, wherein the conditioning circuit comprises: at least a filter configured to select a high frequency range of an electric signal coming from the motor; at least a comparative means electrically connected to the filter and capable of comparing a reference signal coming from the filter to a detection signal, and the comparing means is configured to obtain the reference signal before the piston attains the upper dead center, and obtain the detection signal after the piston attains the upper dead center; and at least a monitoring means the electric signal associated to the comparing means output, and the monitoring means is configured to detect impact when the comparing means indicates that the detection signal presents a variation in relation to the reference signal, considering a pre-established tolerance.

The third objective of the present invention is achieved by the provision of a gas compressor comprising at least a cylinder and a piston driven by a linear motor; and at least a detector of impact between the cylinder and the piston, the detector being electrically connected to the motor and being in accordance with the one mentioned above.

The fourth objective of the present invention is achieved by the provision of a control system for the cylinder and piston set driven by a linear motor, the control system comprising at least a controller operatively connected to the motor; and at least a detector of impact between the cylinder and the piston, the detector being electrically connected to the controller and being in accordance with the one mentioned above.

SUMMARIZED DESCRIPTION OF THE DRAWINGS

Figure 2:
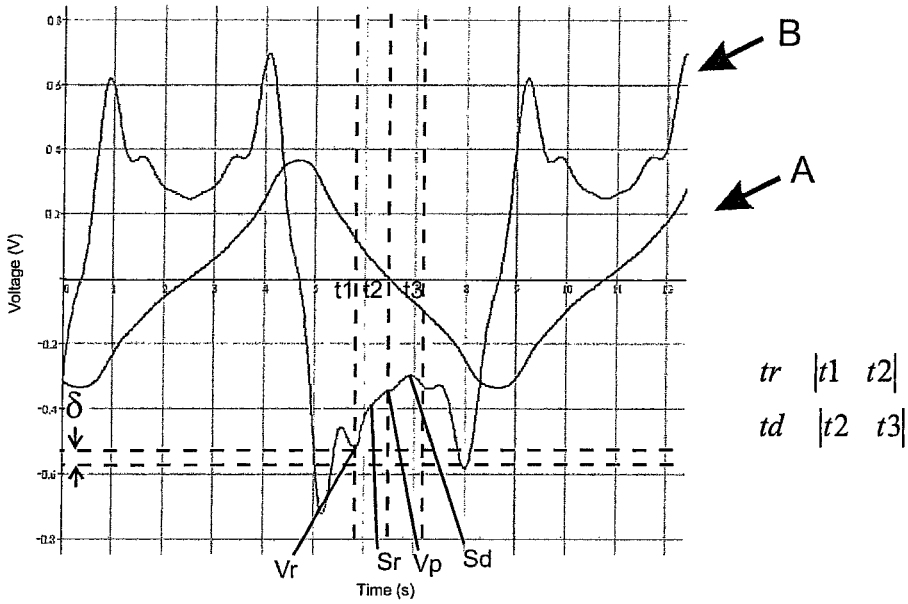
Figure 3:
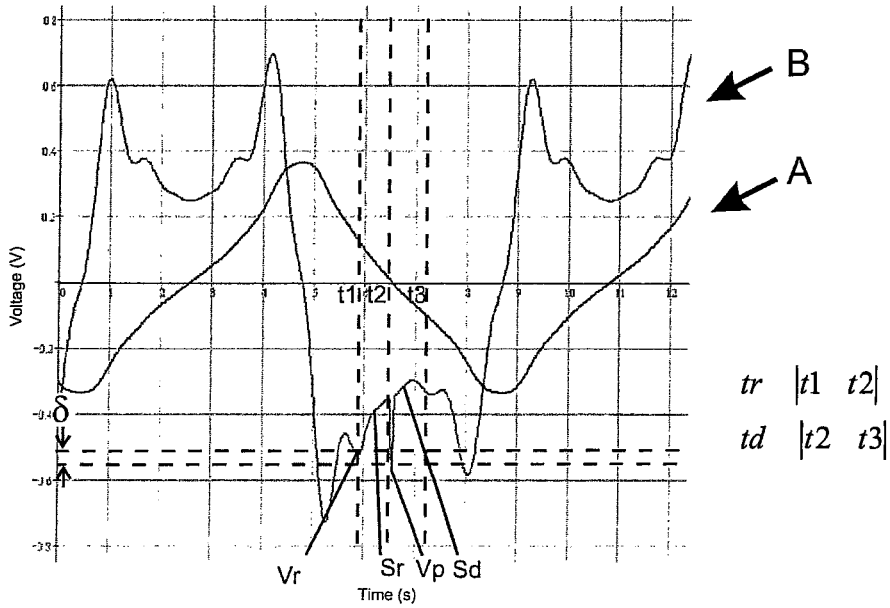
Figure 4:
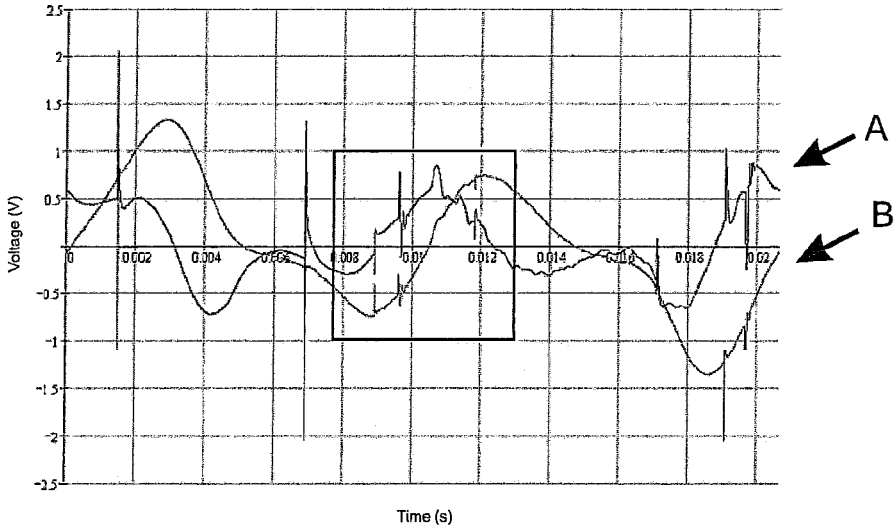
Figure 5:
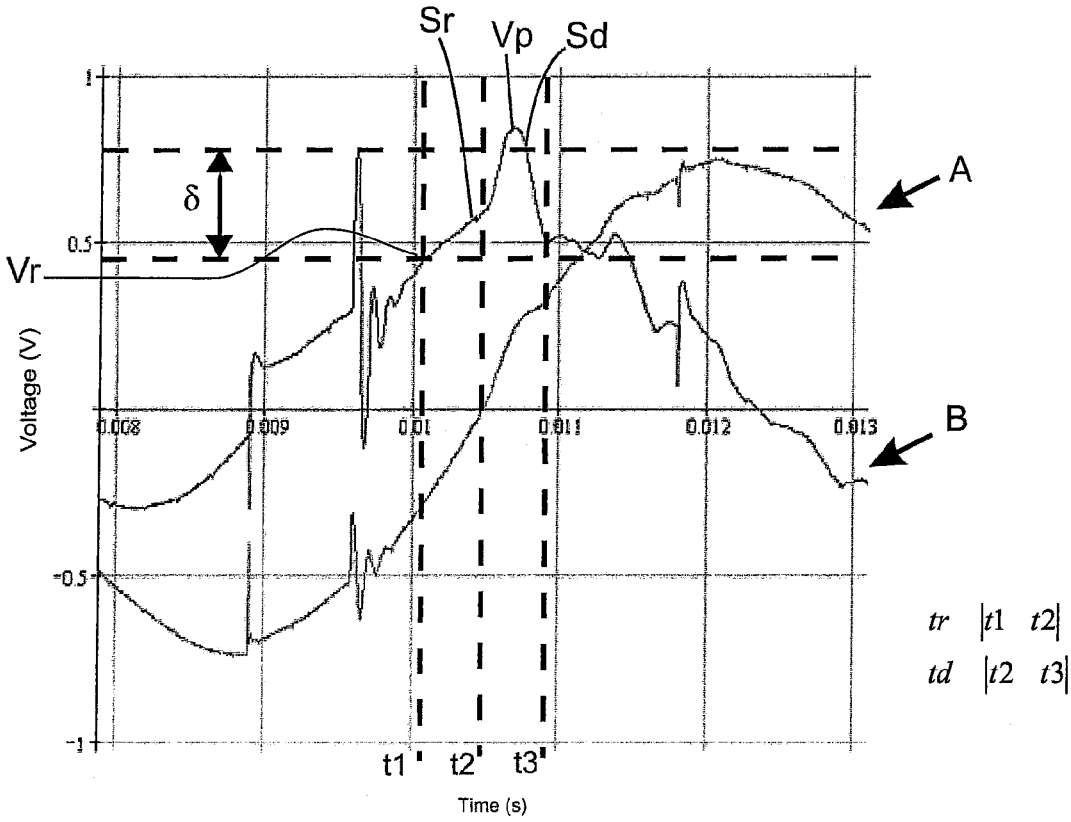
Figure 6:
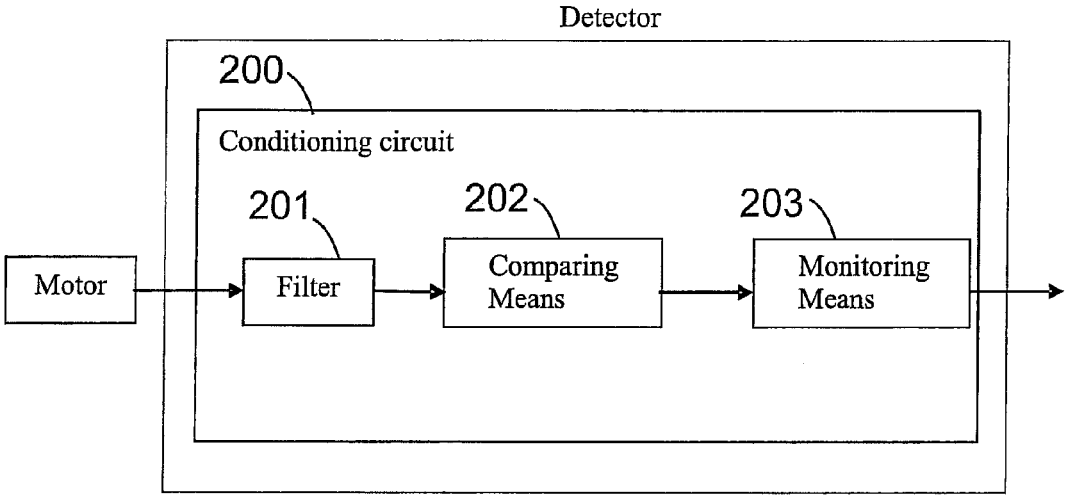
Fig. 6 Prior Art
Figure 7:
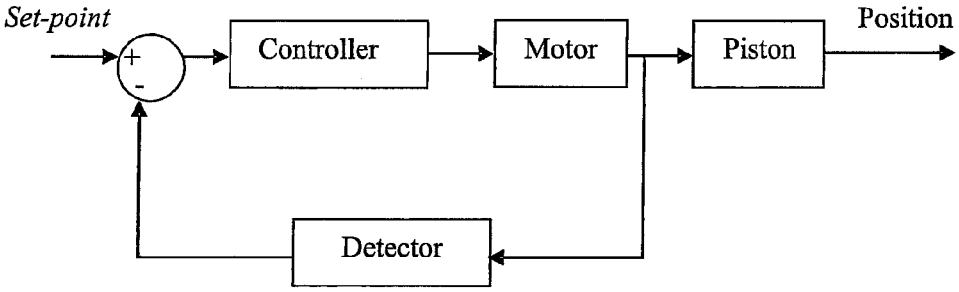

The present invention will next be described in further detail, with reference to the appended drawings, in which:

FIG. 1—is a cross-sectional view of a compressor to which the method of detecting impact between the cylinder and piston according to the present invention is applied;

FIG. 2—represents a graph illustrating curves of the linear motor in a situation in which no impact occurs between the cylinder and the piston;

FIG. 3—represents a graph illustrating curves of the linear motor in a first situation in which impact occurs between the cylinder and the piston;

FIG. 4—represents a graph illustrating curves of the linear motor in a second situation in which impact occurs between the cylinder and the piston;

FIG. 5—represents an amplification of the area highlighted in the graph illustrated in FIG. 4, showing the region illustrating the impact between the cylinder and the piston;

FIG. 6—represents a block diagram illustrating the elements of a detector of impact between the cylinder and the piston, the object of the present invention; and FIG. 7—represents a block diagram illustrating a control system of a cylinder and piston set, object of the present invention.

DETAILED DESCRIPTION OF THE DRAWINGS

Piston and Cylinder Set Driven by Linear Motor

FIG. 1 illustrates a compressor with linear motor to which the piston and cylinder set driven by linear motor having a detector of impact between the cylinder 2 and piston 1 according to the present invention.

The piston and cylinder set, illustrated in a preferred embodiment in FIG. 1, comprises a cylinder 2, which has a valve board at its upper end, also referred to as valve head. This valve board comprises a suction valve of air 3*a* that allows low pressure air into the cylinder 2, and a discharge valve of air 3*b* that discharges high pressure air out of the cylinder 2, if the piston and cylinder set is applied to an air compressor.

In other applications of the piston and cylinder set, the suction and discharge valves 3*a* and 3*b*, which communicate with the inside of the cylinder 2, may operate with other types of fluid. For example, if the piston and cylinder set is applied to a pump, valves 3*a* and 3*b* may allow in and discharge another type of fluid, such as water.

The piston and cylinder set also comprises a piston 1 that dislodges inside the cylinder 2, jointly constituting a resonating set. Inside the cylinder 2, the piston 1 carries on alternate linear motion, exerting an action of compressing the gas allowed inside the cylinder 2 by the suction valve 3*a*, until the point where this gas can be discharged to the high pressure side, by the discharge valve 3*b*.

The piston 1 is coupled to at least a magnet 5, such that the displacement of the piston 1 causes the corresponding displacement of the magnet 5 and vice-versa. The magnet 5 is preferably disposed around the outer surface of the piston 1, as can be seen in FIG. 1. In alternative embodiments of the invention, the magnet may be connected to the piston 1 in different ways, for example, being fixed to a stem which is connected to the piston 1.

The piston and cylinder set also has a support structure 4 which can serve as support for the piston 1 and/or as a guide for the displacement of the piston 1 and/or the magnet 5. Along at least part of the support structure 4, an air gap 12 is formed wherein the magnet dislodges.

In a preferred embodiment of the invention shown in FIG. 1, two helicoidal springs 7*a* and 7*b* are mounted against the piston 1, on either side thereof, and said springs are preferably always compressed. The piston 1, jointly with the mobile parts of the actuator and the helicoidal springs, for the resonating set of the compressor.

The actuator of the piston and cylinder set is comprised of at least a motor coil 6, electrically powered in order to produce a magnetic field. The motor coil 6 must be disposed such that the magnetic field generated thereby acts on the displacement path of the magnet 5 of the piston 1.

Therefore, when the motor coil is electrically powered, it generates a magnetic flow at least along part of the air gap 12, and which can be variable and controlled, in accordance with the power voltage applied to the motor coil 6. Consequently, the variation of the magnetic field generated by the motor coil 6 as a result of the voltage applied thereto induces the magnet 5 to move reciprocatingly along the air gap 12, making the piston 1 move away from and approach the valve boards 3*a* and 3*b* of the cylinder 2, thus compressing the gas allowed inside the cylinder 2. The amplitude operation of piston 1 corresponds to the total amplitude of displacement of the piston 1 inside the cylinder 2.

The piston 1 operation amplitude is regulated by the balance of the power generated by the actuator and the power consumed by the mechanism in the gas compression and other losses. To obtain the maximum pumping capacity of the piston and cylinder set, it is necessary to operate at an amplitude wherein the piston 1 moves as closes as possible to the valve boards 3*a*, 3*b*, but without impact or collision. Such impact is undesirable, as it causes a loud noise, and, what is more, successive impacts occurring continuously during the use of the equipment may cause damage thereto.

Method of Detecting Impact Between the Cylinder and Piston Driven by a Linear Motor The approach of the present invention consists of a methodology capable of detecting at least an impact between the piston 1 and cylinder 2 so that a suitable control system is capable of decreasing the incidence and even avoiding future impacts based on information provided by this methodology.

The method of detecting an impact between the cylinder 2 and the piston 1 driven by a linear motor comprises a first step i) of obtaining a reference signal Sr, associated to an electrical output of the linear motor, during a reference time interval Δtr. Preferably, the electrical output of the linear motor in an electric voltage signal, but other magnitudes can be used such as, for example, electric current. This electric output is treated by a filter that only allows the passage of a range of high frequencies. For the present invention, a range of high frequencies comprises the frequency that can be presented by the response of the impact between the cylinder and the piston. Said frequency is relatively higher than the normal operating frequency of the compressor. Thus, the filter is tuned to separate the operating frequency of the compressor from the frequency of the signal resulting from impact between the cylinder and the piston. Accordingly, the reference signal Sr is a signal filtered from the electrical output of the linear motor. In FIGS. 2 to 5, the filtered electric signal is represented by curve "B" and the original signal is represented by curve "A".

The reference time interval Δtr corresponds to a "window of time" elapsed between a first instant t1 and a second instant t2, wherein the second instant t2 occurs after the first instant t1 (t2>t1). The second instant t2 corresponds to the instant in which the piston 1 attains the upper dead center or maximum point. In this instant t2, the electric voltage signal attains zero value, as can be seen in the graphs of 2 to 5 (crossing point of the voltage curve in the abscissa or time axis). So, in the present invention, this crossing can be used to ascertain the instant in which the piston 1 attained its maximum point when it could collide with the cylinder 2.

The first instant t1 can be determined from the second instant t2, such that a time value is subtracted from the second instant t2, wherein said value corresponds to the value of the reference time interval Δtr in modulus. Preferably, the value of the reference time interval Δtr is pre-established. Yet other ways of determining this interval can be used, such as, for example, intelligent techniques based on learning systems.

In an ideal situation, there should be no impact between the piston 1 and the cylinder 2, that is, after the piston 1 attains the upper dead center in the instant t2, it should not collide with the cylinder 2. However, this situation is not always possible, mainly by a simple and low-cost solution, because the motor-cylinder-piston set is often subject to disturbance and external actions that are difficult to quantity in the project phase. Accordingly, oftentimes the impact is unavoidable and, therefore, the present methodology of this invention provides a solution for detecting this impact so that a control system can operate so as to prevent/avoid future impacts or at least diminish the incidence thereof.

This methodology can also be used for tuning position sensors used to determine the position of the piston, such as those described in the state of the art.

The second step ii) of this method consists in obtaining a detection signal Sd associated to said electrical output of the linear motor during a detection time interval Δtd elapsed between the second instant t2 and a third instant t3, wherein the third instant t3 occurs after the second instant t2. Just as in determining the reference time interval Δtr, the detection time interval Δtd is also preferably, but not obligatorily, pre-established.

The following step iii) of the method of the present invention consists in comparing the reference signal Sr with the detection signal Sd. Said comparison can be made using various techniques such as identifying signals, spectral analysis, and other mathematical techniques. It is preferable to use the technique of detecting the maximum (peak) of the detection signal Sd, which will be detailed ahead.

The fourth and last step iv) consists in recording the occurrence of impact when the result of comparison of step iii indicates that the detection signal Sd presents a variation deriving from impact between the cylinder 2 and the piston 1. This indication (impact occurrence decision) is achieved by considering a pre-established tolerance on an admissible variation between the reference signal Sr and the detection signal Sd. Obviously, said tolerance directly depends on the comparison technique adopted for step iii.

Although this methodology is preferably based on detecting the occurrence of impact between the cylinder 2 and the piston 1 in the time domain, it can optionally be based on other sample space domains, such as, for example, in the phase domain.

Technique of Detecting the Maximum

As mentioned previously, the technique of detecting the maximum (peak) of the detection signal Sd is preferably used, because it is easy to implement (development and production), and does not require a complex or high-cost hardware platform.

In said technique, in step iii the difference in modulus (absolute value) is calculated between the peak value Vp of the reference signal Vr and a reference value Vr of the reference signal Sr. Accordingly, in step iv the occurrence of impact is recorded when the result of the calculation of step iii is greater than the pre-established tolerance value δ, which in turn can be determined experimentally or calculated considering noise or signal disturbance.

The reference value Vr of the reference signal Sr is obtained in step i, that is, during the reference time interval Δtr. Said reference value Vr of the motor is preferably obtained in the first instant t1 or in the second instant t2. However, the reference value Vr can be obtained at any instant comprised in the reference time interval Δtr, and the tolerance value δ varies according to the variation of the reference value Vr.

The peak value Vp of the detection signal Sd is obtained in step ii, that is, during the detection time interval Δtd. Said value should be considered in modulus, that is, the peak value Vp is determined in relation to the axis of the abscissa of the graph.

In FIG. 2, it can be observed that the peak value Vp is the voltage value in the second instant t2, because during the detection time interval Δtd, the voltage value in the second instant t2 corresponds to the greatest value (peak) of the detection signal Sd. Since the result of the sum (in modulus) between the reference value Vr, obtained in the first instant t1, and the tolerance value δ was greater than the peak value Vp, it can be concluded that no impact occurred between the cylinder 2 and the piston 1.

In FIG. 3, it can be observed that the peak value Vp occurred during the detection time interval Δtd. Since the result of the sum (in modulus) between the reference value Vr, obtained in the first instant t1, and the tolerance value δ was lower than the peak value Vp, it can be concluded that impact occurred between the cylinder 2 and the piston 1. FIG. 5 shows a similar situation, however, the impact occurs on the positive side of the electric voltage signal.

Note that in FIGS. 2 to 5, the peak value is only evident in the filtered electric signal (curve "B").

There are various ways of implementing the method of the present invention, and one of the possible embodiments consists of attributing to the reference value Vr, the maximum value of the reference signal Sr (occurred during the reference time interval Δtr), and the impact is detected when the level of the detection signal Sd (occurred during the detection time interval Δtd) attains the reference value Vr plus the tolerance value δ.

Alternatively, it is possible to determine the peak value Vp, by way of the following substeps:

a) sampling of a finite number of comparison values Vc of the reference signal Sr;

b) calculation of the modulus of the difference between each of the comparison values Vc and the detection signal values Sd;

c) comparison between all the values calculated in substep b;

d) selection of the highest value obtained in substep c; and e) attribution of the value obtained in substep d as being the peak value Vp.

Determining and obtaining the value of the electric signal, corresponding to the instant in which the impact occurred (peak value Vp), allows the tuning of position sensors associable to cylinder and piston sets for certain compressor models. As described above, this value of the electric signal is obtained in the situation in which the piston 1 attains its maximum position inside the cylinder 2, that is, the upper dead center. Consequently, in a process of tuning the position sensor, the peak value Vp can be used as the value in which the position sensor should interpret as being that corresponding to the maximum position that the piston attains inside the cylinder.

Optionally, other sensor tuning techniques can be used to measure the position of the piston 1 inside the cylinder 2 by applying the method of the present invention. Analogically, this method can also be used to tune a device capable of estimating the position of the piston 1 inside the cylinder 2, instead of the position sensor per se.

Detector of Impact Between the Cylinder and the Piston

The method of the present invention can be implemented by a detector device that comprises a hardware platform such as an electronic board having components and/or microprocessors capable of executing the steps of this methodology. So, the methodology can be implemented by an electronic board entirely composed of analogical and/or digital components that form an electronic circuit, thus dispensing with the use of a software (processed in the microcontroller or microprocessor). Said implementation will not be detailed here as it is common knowledge for a person skilled in the art. A preferred embodiment of the detector is schematically illustrated in FIG. 6.

Accordingly, this hardware platform is a conditioning circuit (treatment) 200 that comprises at least a filter 201 configured to select a high frequency range of an electric signal coming from the motor, blocking the medium and low frequencies of the signal.

The conditioning circuit 200 also comprises at least a comparing means 202 electrically connected to the filter 201, and the comparing means 202 is configured to compare the reference signal Sr coming from the filter 201 with the detection signal Sd, also coming from the filter 201.

The reference signal Sr is obtained during the reference time interval Δtr elapsed between the first instant t1 and the second instant t2, wherein the second instant t2, which occurs after the first instant t1, corresponds to the instant in which the piston 1 attains the upper dead center.

The detection signal Sd is obtained during the detection time interval Δtd elapsed between the second instant t2 and the third instant t3, wherein the third instant t3 occurs after the second instant t2.

The conditioning circuit 200 also comprises at least a monitoring means 203 the electric signal, associated to the comparing means 202 output 202, configured to receive the information of the occurrence of impact. Optionally, the monitoring means 203 and the comparing means 202 can be included in a single component or device.

Detecting impact by monitoring means 203 occurs when the comparing means 202 indicates that the detection signal Sd presents a variation in relation to the reference signal Sr, considering a pre-established tolerance.

Preferably, the comparing means 202 makes the comparison by subtracting the reference value Vr from the detection signal Sd, wherein the reference value Vr corresponds to a pre-established value of the reference signal Sr. Detecting impact by monitoring means 203 occurs when the level of the detection signal Sd exceeds the reference value Vr plus a pre-established tolerance value δ.

Consequently, the detector operates as an equivalent to a sensor, and its main purpose is to identify whether impact of piston 1 with the cylinder 2 occurred at the maximum point or upper dead center.

The cylinder 2 and the piston 1 driven by a linear motor, as illustrated in FIG. 1, and the conditioning circuit 200 electrically connected to the motor form a complete gas compressor equipment 100, which is also an object of the present invention.

Control System

Still concerning FIG. 1, the piston 1 of the piston and cylinder set according to the invention is connected to the magnet 5, which moves in a displacement path that comprises an air gap 12 formed between the support part 4, and the motor coil 6 coupled to the stator 10. This movement of the magnet induces the alternate movement of the piston 1 inside the cylinder 2, compressing the gas allowed inside the cylinder 2 by the suction valve 3*a*, and discharging the high pressure gas by way of the discharge valve 3*b*.

The linear compressor is mounted inside a chassis 11. The space formed between the compressor and the chassis constitutes a low pressure chamber 13, where the low pressure gas is contained. The suction valve 3*a* of the cylinder 2 communicates with the low pressure chamber 13 and allows gas inside the cylinder 2. The discharge valve 3*b* of the cylinder 2 discharges the high pressure gas, which was compressed inside the cylinder 2 by the compression motion of the piston 1, to a hermetically-isolated high pressure region of the low pressure chamber.

The displacement amplitude of the piston 1 inside the cylinder 2 can be controlled by a suitable control system.

In this sense, the impact detector can be comprised by a control system, operating analogically to a sensor, as illustrated in the block diagram of FIG. 7. Said system controls the cylinder 2 and a piston 1 set driven by a linear motor, as already described above. The system comprises at least a controller operatively connected to the motor, and the impact detector is electrically connected to said controller.

Various known control techniques can be adopted, such as PID control, always with a view to preventing and/or reducing the incidence of impacts between the piston 1 and the cylinder 2.

Preferably, the control variable is the voltage of the motor, however, other magnitudes can be used to control the position of the piston 1, provided that they are suitable for this application.

This control system presents good precision, because it is indirectly based on a learning system in accordance with the individual behavior of the compressor, and the information obtained from the collisions occurred is stored and used to prevent/reduce future collisions.

Consequently, the compression equipment according to the invention is capable of operating so as to optimize its compression capacity, since it has a significantly reduced anti-collision safety distance, and consequently also optimizing the power consumption of the equipment.

Accordingly, as can be clearly understood from the preceding description, the present invention is capable of avoiding the need to measure the displacement amplitude of the piston 1 inside the cylinder 2, presenting high precision.

Additionally, the equipment for detecting the displacement amplitude of the piston 1 inside the cylinder 2 is altogether simple, as it essentially consists of an electronic board positioned in any suitable place, and the signal generated by this board, or a specific variation this signal undergoes, is sufficient to indicate that the piston 1 has collided with the cylinder 2. Thus, the equipment dispenses with the use of sensors, whereby reducing costs.

Having described examples of preferred embodiments, it must be understood that the scope of the present invention encompasses other potential variations, and is only limited by the content of the claims appended hereto, other possible equivalents being included therein.

The invention claimed is:

1. A method of detecting impact between a cylinder (2) and a piston (1) driven by a linear motor, said method comprising:

i) obtaining a reference signal (Sr) during a reference time interval (Δtr) before the piston attains an upper dead center position, the reference signal (Sr) varying with an electrical output of the linear motor and the reference time interval (Δtr) being defined between a first instant (t1) and a second instant (t2), wherein the second instant (t2) occurs after the first instant (t1), and the second instant (t2) corresponds to the instant the piston (1) attains the upper dead center position, and obtaining a reference value (Vr) from the reference signal (Sr);

ii) obtaining a detection signal (Sd) during a detection time interval (Δtd) after the piston attains the upper dead center position, the detection signal (Sd) varying with said electrical output of the linear motor and the detection time interval (Δtd) being defined between the second instant (t2) and a third instant (t3), wherein the third instant (t3) occurs after the second instant (t2), and obtaining a peak value (Vp) from the detection signal (Sd);

iii) calculating a difference between the reference value (Vr) and the peak value (Vp), where the difference is compared to a pre-established tolerance value δ; and iv) recording an occurrence of impact between the cylinder (2) and the piston (1) when the result of the calculation of step iii) is higher than the pre-established tolerance value δ.

2. The method according to claim 1, wherein the reference signal (Sr) of step i) and the detection signal (Sd) of step ii) are both filtered signals from said electrical output of the linear motor, and each of said filtered signals contain high frequency components of the electrical output of the linear motor.

3. The method according to claim 1, wherein the reference time interval (Δtr) defined between the first instant (t1) and the second instant (t2) is a pre-established time interval.

4. The method according to claim 1, wherein the detection time interval (Δtd) defined between the second instant (t2) and the third instant (t3) is a pre-established time interval.

5. The method according to claim 1, wherein in step i), the reference value (Vr) of the linear motor is obtained in either the first instant (t1) or in the second instant (t2).

6. The method according to claim 1, wherein in step i), the reference value (Vr) of the linear motor corresponds to the maximum value of the reference signal (Sr).

7. The method according to claim 1, wherein in step ii), the peak value (Vp) obtained is used to fine-tune position sensors of the piston (1) inside the cylinder (2), and the peak value (Vp) corresponds to the maximum position that the piston (1) attains inside the cylinder (2).

8. An impact detector between a cylinder (2) and a piston (1) driven by a linear motor, said impact detector comprising at least a conditioning circuit (200) electrically connected to the linear motor, wherein the conditioning circuit (200) comprises:

a filter (201) to select and output a high frequency signal range of an electric signal coming from the linear motor, wherein the electric signal from the linear motor comprises a reference signal (Sr) and a detection signal (Sd);

a comparing means (202) electrically connected to the filter (201), the comparing means (202) comparing the reference signal (Sr) from the filter (201) to the detection signal (Sd) from the filter (201), and the comparing means is configured to:

obtain the reference signal (Sr) from the high frequency signal output by the filter (201) before the piston attains an upper dead center position during a reference time interval (Δtr) defined between a first instant (t1) and a second instant (t2), wherein the second instant (t2) occurs after the first instant (t1), and the second instant (t2) corresponds to the instant the piston (1) attains the upper dead center position, obtain a reference valve (Vr) from the reference signal (Sr);

obtain the detection signal (Sd) from the high frequency signal output by the filter (201) after the piston attains the upper dead center position during a detection time interval (Δtd) defined between the second instant (t2) and a third instant (t3), wherein the third instant (t3) occurs after the second instant (t2), obtain a peak value (Vp) from the detection signal (Sd);

wherein the comparing means subtracts the reference value (Vr) from the peak value (Vp) of the detection signal and a result of said subtraction is an output of the comparing means; and a monitoring means (203) which monitors the output of the comparing means (202), wherein the monitoring means (203) detects an impact between the piston and cylinder when the output of the comparing means (202) is greater than a pre-established tolerance value (δ).

9. A gas compressor (100) comprising at least a cylinder (2) and a piston (1) driven by a linear motor, the gas compressor (100) comprising at least an impact detector between the cylinder (2) and the piston (1), the impact detector being electrically connected to the motor, the impact detector comprising:

a conditioning circuit (200) electrically connected to the linear motor of the gas compressor, wherein the conditioning circuit (200) comprises:

a filter (201) to select and output a high frequency signal range of an electric signal coming from the linear motor;

wherein the electric signal from the linear motor comprises a reference signal (Sr) and a detection signal (Sd);

a comparing means (202) electrically connected to the filter (201), the comparing means (202) comparing the reference signal (Sr) from the filter (201) to the detection signal (Sd) from the filter (201), and the comparing means is configured to:

obtain the reference signal (Sr) from the high frequency signal output by the filter (201) before the piston attains an upper dead center position during a reference time interval (Δtr) defined between a first instant (t1) and a second instant (t2), wherein the second instant (t2) occurs after the first instant (t1), and the second instant (t2) corresponds to the instant the piston (1) attains the upper dead center position, obtain a reference value (Vr) from the reference signal (Sr);

obtain the detection signal (Sd) from the high frequency signal output by the filter (201) after the piston attains the upper dead center position during a detection time interval (Δtd) defined between the second instant (t2) and a third instant (t3), wherein the third instant (t3) occurs after the second instant (t2), obtain a peak value from the detection signal (Sd);

wherein the comparing means calculates the difference between the reference value (Vr) and the peak value (Vp) of the detection signal and a result of said calculation is an output of the comparing means; and a monitoring means (203) which monitors the output of the comparing means (202), wherein the monitoring means (203) detects an impact between the cylinder and piston of the gas compressor when the output of the comparing means (202) is above a pre-established tolerance value (δ).

10. A control system for a cylinder (2) and a piston (1) set driven by a linear motor, the control system comprising at least a controller operatively connected to the motor, the control system comprising an impact detector between the cylinder (2) and the piston (1), the impact detector being electrically connected to the controller, the impact detector comprising:

a conditioning circuit (200) electrically connected to the linear motor, wherein the conditioning circuit (200) comprises:

a filter (201) configured to select and output a high frequency range of an electric signal coming from the motor;

a comparing means (202) electrically connected to the filter (201), the comparing means (202) comparing a reference signal (Sr) coming from the filter (201) to a detection signal (Sd) coming from the filter (201), and the comparing means is configured to:

obtain the reference signal (Sr) from the high frequency signal output by the filter (201) before the piston attains an upper dead center position during a reference time interval (Δtr) defined between a first instant (t1) and a second instant (t2), wherein the second instant (t2) occurs after the first instant (t1), and the second instant (t2) corresponds to the instant the piston (1) attains the upper dead center position, obtain a reference value (Vr) from the reference signal (Sr); and obtain the detection signal (Sd) from the high frequency signal output by the filter (201) after the piston attains the upper dead center position during a detection time interval (Δtd) defined between the second instant (t2) and a third instant (t3), wherein the third instant (t3) occurs after the second instant (t2), obtain a peak value (Vp) from the detection signal (Sd);

wherein the comparing means calculates the difference between the reference value (Vr) and the peak value (Vp) of the detection signal and a result of said calculation is an output of the comparing means; and a monitoring means (203) for monitoring the electric signal associated to the output of the comparing means (202), wherein the monitoring means (203) is configured to detect an impact when the output of the comparing means (202) is higher than a pre-established tolerance value (δ).

11. A control system for a cylinder (2) and a piston (1) set driven by a linear motor, the control system comprising at least a controller operatively connected to the motor, and an impact detector between the cylinder (2) and the piston (1), the impact detector being electrically connected to the controller, the impact detector comprising:

a conditioning circuit (200) electrically connected to the linear motor, wherein the conditioning circuit (200) comprises:

a filter (201) to select and output a high frequency signal range of an electric signal coming from the linear motor;

a comparing means (202) electrically connected to the filter (201), the comparing means (202) comparing a reference signal (Sr) coming from the filter (201) to a detection signal (Sd) coming from the filter (201), and the comparing means is configured to:

obtain the reference signal (Sr) from the high frequency signal output by the filter (201) before the piston attains an upper dead center position during a reference time interval (Δtr) defined between a first instant (t1) and a second instant (t2), wherein the second instant (t2) occurs after the first instant (t1), and the second instant (t2) corresponds to the instant in which the piston (1) attains the upper dead center position, obtain a reference value (Vr) from the reference signal (Sr); and obtain the detection signal (Sd) from the high frequency signal output by the filter (201) after the piston attains the upper dead center position during a detection time interval (Δtd) defined between the second instant (t2) and a third instant (t3), wherein the third instant (t3) occurs after the second instant (t2), obtain a peak value (Vp) from the detection signal (Sd);

wherein the comparing means calculates the difference between the reference value (Vr) and the peak value (Vp) of the detection signal and a result of said calculation is an output of the comparing means;

a monitoring means (203) for monitoring the electric signal associated to the output of the comparing means (202), wherein the monitoring means (203) is configured to detect an impact when the output of the comparing means (202) is greater than a pre-established tolerance value (δ);

and wherein the reference signal (Sr) and the detection signal (Sd) are signals filtered from the electrical output of the motor, and said signals contain high frequency components of the electrical output of the motor.

* * * * *